US005695052A

United States Patent [19]

Damato

[11] Patent Number: 5,695,052

[45] Date of Patent: Dec. 9, 1997

[54] PLATE WITH RECEPTACLE FOR BEVERAGE CONTAINER

[76] Inventor: Ginger L. Damato, 1107 N. Tenth Ave., Melrose Park, Ill. 60160

[21] Appl. No.: 917,400

[22] Filed: Jul. 23, 1992

Related U.S. Application Data

[63] Continuation of Ser. No. 585,520, Sep. 20, 1990, abandoned.

[51] Int. Cl.[6] ..... B65D 1/34

[52] U.S. Cl. ..... 206/217; 206/562; 206/565; 229/904

[58] Field of Search ..... 220/737, 738, 220/574, 23.83, DIG. 5; 206/217, 218, 426, 562, 565; 229/1.5 H, DIG. 7, 904; 248/311.2

[56] References Cited

U.S. PATENT DOCUMENTS

| | | | |
|---|---|---|---|
| 1,616,570 | 2/1927 | Boynton | 229/DIG. 7 X |
| 2,314,935 | 3/1943 | Gutterman | 206/565 X |
| 2,321,519 | 6/1943 | Rubinoff | 229/1.5 H X |
| 2,766,919 | 10/1956 | Randall | 229/904 X |
| 4,511,042 | 4/1985 | Wischusen, III | 206/562 X |
| 4,718,594 | 1/1988 | Harazi | 229/DIG. 7 X |
| 4,736,488 | 4/1988 | Nielsen | 220/DIG. 5 X |
| 4,823,958 | 4/1989 | Mahmud | 206/217 X |
| 4,863,094 | 9/1989 | Morrow et al. | 206/562 X |
| 4,938,411 | 7/1990 | Rizzuto | 229/DIG. 7 X |
| 5,058,737 | 10/1991 | Patterson et al. | 220/574 X |
| 5,060,820 | 10/1991 | Boerner | 220/574 |

*Primary Examiner*—Jacob K. Ackun
*Attorney, Agent, or Firm*—Patula & Associates

[57] ABSTRACT

A food support device with beverage fixture comprised of a polygonal planar food support surface. A dimensionally adaptable cavity is positioned within the planar food support surface, whereby a beverage container of varying diameter and type is insertable into the cavity whereby the planar food support surface is supported thereby. Various portions may be configured into the food support surface in order to segregate various foodstuffs from one another. A raised lip along the perimeter of the planar food support surface and the perimeter of the cavity is desirable.

14 Claims, 4 Drawing Sheets

PLATE WITH RECEPTACLE FOR BEVERAGE CONTAINER

This application is a continuation of U.S. patent application Ser. No. 07/585,520 filed Sep. 20, 1990 and now abandoned.

This invention relates to a combination food plate assembly with a fixture to be supported by beverage container.

BACKGROUND OF THE INVENTION

It has always been a problem at social functions to be able to gather food from either a buffet line or other source and to place the food on a plate or tray and still be able to support a beverage such as a can, bottle, glass or cup. The user must continually either set the plate or the beverage container down in order to greet others or to acquire further foodstuffs, such as canapes or hors d'oeuvres. There is a distinct need for a method of supporting a food support surface, such as a plate or tray, with a beverage container of any type, size or shape and still have the user's other hand free while using the device.

Although there have been many devices throughout the ages that support not only foodstuffs and beverage containers, they have not always been adaptable to the various types of beverage containers nor have they been readily supported by a user with one hand without causing accidents by tipping or spilling. For example, U.S. Pat. No. 2,042,801 to Pittman; U.S. Pat. No. 1,544,972 to Gebelein; U.S. Pat. No. 2,003,895 to Martin, all of which suffered the unavoidable consequence in that there are highly specific to supporting a particular beverage container of certain size or shape primarily on an outer edge of a tray or plate. Adherent to their design, they have a tendency to be tipped over or require the user to counteract the unbalance created by the beverage container positioned at one side.

Furthermore, there have been known devices which were additional support devices which were affixed in some manner to an existing plate or tray, which supported a beverage container above the plate and again suffer from the same shortcomings of creating an unbalance and having only limited adaptability to various sizes and types of beverage containers; U.S. Pat. No. Reissue 13,825 to Blackwell; U.S. Pat. No. 2,721,459 to Berg; U.S. Pat. No. 1,258,792 to Lorimar; U.S. Pat. No. 2,413,535 to Weidler; U.S. Pat. No. 2,411,864 to Birkin; U.S. Pat. No. 2,427,697 to Weidler.

Further advances identified food supports with beverage containers requiring form fitted designs to function with a particular container such as that shown in U.S. Pat. No. 3,955,672 to Brundand which require not only support, it requires the user to balance the plate on the user's forearm thereby attempting to stabilize the plate in at least two of the directions in which a plate may be supported. The further shortcoming of Brundand is the accidental tilt of the plate and can cause substantial tipping of the food stuffs either toward user on his or her person causing clothing damage and harm or away from the user on to others and on to the floor, etc.

U.S. Pat. No. 4,732,274 to Bouton; discloses a portable tray in which the beverage is supported within and having a cut out portion to expose the cup holder and permit the user to insert a hand to grasp the cup presumably to provide greater support for the beverage container to avoid tipping and spillage. This appears to be a cumbersome and requires a lot of dexterity to grip the plate, unlike the present invention which the users firmly grasp only the beverage container.

Devices such as these disclosed in U.S. Pat. Nos. Des 278,198, Des 278,197, and U.S. Pat. No. 4,461,396 all to Harper; disclose a plate in which the beverages supported on the upper surface and to which the users must place his or her thumb through the opening to grasp the lip of a lipped supported beverage container. This invention obviously rather requires some dexterity of holding the plate not only by the individuals thumb but further more restricted to containers having support footed lips in which the users may grasp their thumb thereupon. Unlike the present invention, Harper would have no applicability to standard flat bottom glasses, bottles or cans.

Devices such as that disclosed in U.S. Pat. No. 4,607,758 to Stevens; disclose expensively formed food serving trays having special cut outs for supporting glass stemware in which the beverage container or stemware in supported by the plate and extends downward. This is unlike the present invention which utilizes the support of the beverage container to support to the actual food surface.

U.S. Pat. No. 2,240,020 to Raiser; discloses a complicatedly formed tray having a beverage support placed therewithin the center which requires the user to support the specially formed plate which a beverage container may be inserted there into. However, the device does not provide readily adaptability to various size beverage containers in that it requires the use of various other internal supports to accommodate the various beverage containers desire to be used.

The present invention is particularly adaptable for use in a disposable tray/plate configuration which can support both food stuffs and a beverage and needs only to be carried by one hand. It is particularly desirable if the food support would be designed including not only a surface for a supporting food and means for adapting to any size beverage container whether it be a glass, cup, bottle or can which would not only support the food surface area but food condiments as well. The present invention allows the user to permit their other hand to be used for consuming the food and the beverage as well to greet others and have a free hand.

No known patents offer such a unique combination of features yet at a reasonable cost and without substantial investment in redesigning current plates thereto.

Numerous other advantages and features of the invention will become readily apparent from the detailed description of the preferred embodiment of the invention, from the claims, and from the accompanying drawings, in which like numerals are employed to designate like parts throughout the same.

SUMMARY OF THE INVENTION

The present invention relates to a food surface with beverage fixture which has a perforated area within the planar surface of the food support surface and may or may not have a lip around the perimeter of the planar surface to-prevent the food stuffs from sliding off or spilling. Likewise a perimeter lip could be formed along the resilient perforated area to prevent spillage. The perforations would be preferably starting from an epicenter point and extending outward to any desired distance in that the perforations would be such that the user upon grasping the plate would insert his or her beverage of choice, be it a bottle, can, glass or cup into the perforations thereby releasing the perforations and supporting the beverage container with the food surface thereon allowing the user to permit their free hand to acquire and temporarily store foodstuffs such as appetizers, pizza, french fries, etc. on the food surface area as desired.

The beverage container may be supported not only from beneath the planar food surface area but likewise above.

In the preferred embodiment, the present invention may be formed from ordinary materials such as fiberboard, paper, styrofoam, or various plastics or whatever is adaptable to providing rigid support. Divider ribs of any shape and size and quantity may be configured in the planar food surface as desired in order to separate foods and to ensure that foods do not stray into each other's areas.

The present invention could be constructed readily to either currently existing plates by the use of a die or other cutting device which would take an existing disposable plate of paper, styrofoam, etc. and create a star-shaped or other configuration into a plate thereby creating the perforations necessary to create the cavity into which the beverage container may be inserted. Furthermore, the creation of fingers by the release of the perforations creating the cavity help provide resilient gripping upon the beverage container so that the food surface planar area does not slide up or down along the beverage surface while being supported by the user.

Accordingly, it is a principle object of the present invention to provide a simple, inexpensive, and disposable food surface plate in which to insert a beverage container of varying size, shape and type and may be adaptable at any time for various users of the various beverage types.

Another object of the present invention is to provide an improved plate capable of supporting not only food stuffs, but various shaped beverages simultaneously so as to permit the user to have a free hand while in use.

A further object of the present invention is to provide an improved method of supporting and resiliently gripping various sized beverage containers onto the tray device by the use of perforated fingers created within the planar food surface.

Still further object of the present invention is to provide an improved plate with beverage fixture which is disposable.

Yet another object of the present invention is to provide an improved plate with beverage fixture which is easy to manufacture and inexpensive in cost.

BRIEF DESCRIPTION OF THE DRAWINGS

A fuller understanding of the invention, references had to the following description taken in connection with the accompanying drawings in which.

DESCRIPTION OF THE PREFERRED EMBODIMENTS

Figure 1:
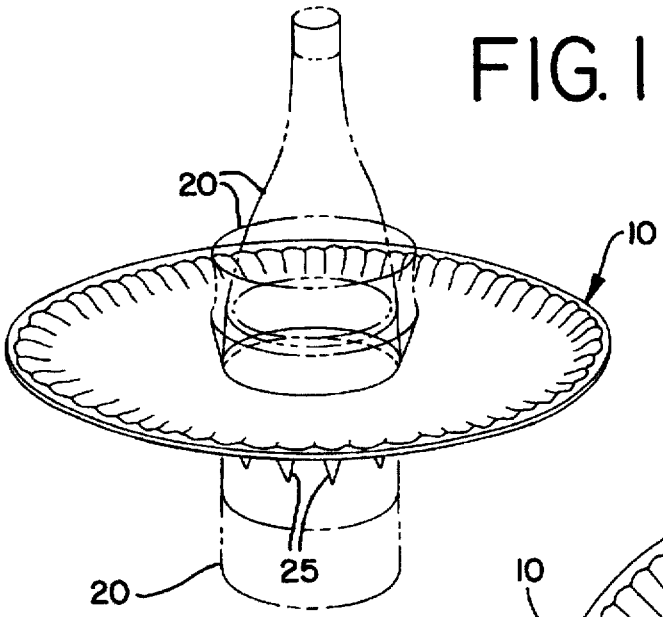
FIG. 1 is a perspective view of the present invention utilizing various beverage containers therewithin.
Figure 2:
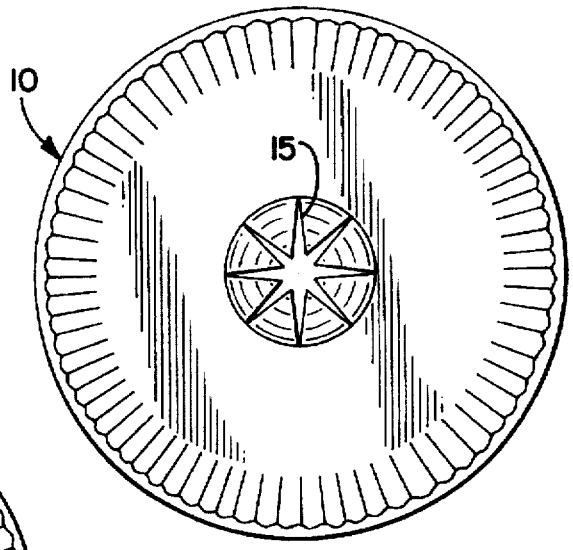
FIG. 2 is a top view of the present invention of FIG. 1.
Figure 3:
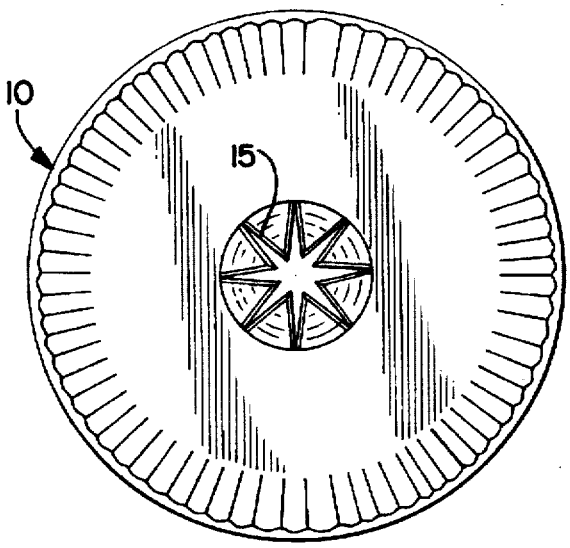
FIG. 3 is a bottom view of the present invention of FIG. 1.
Figure 4:
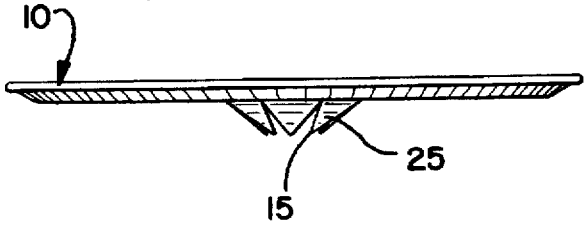
FIG. 4 is a side view of the present invention of FIG. 1.
Figure 5:
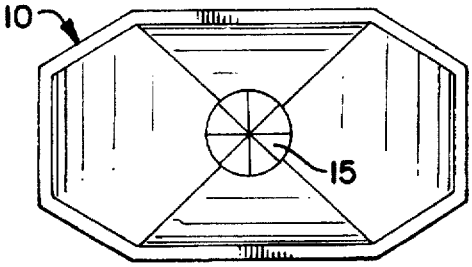
FIG. 5 is a top plan view of a hexagonal configuration of the present invention.
Figure 6:
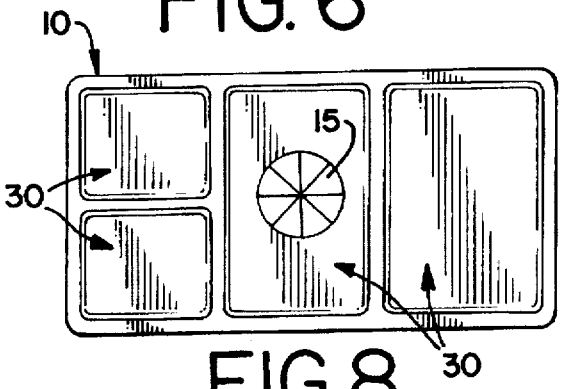
FIG. 6 is a top plan view of a rectangular embodiment of the present invention.
Figure 7:
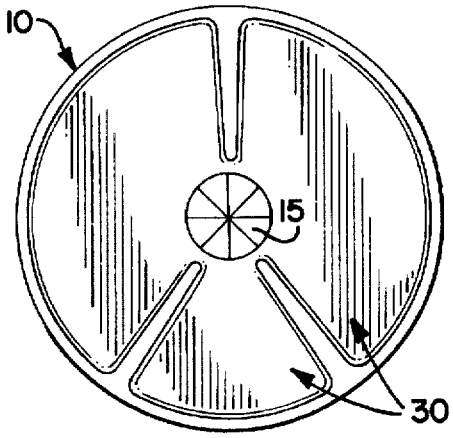
FIG. 7 is a top plan view of a circular configuration of the present invention.
Figure 8:
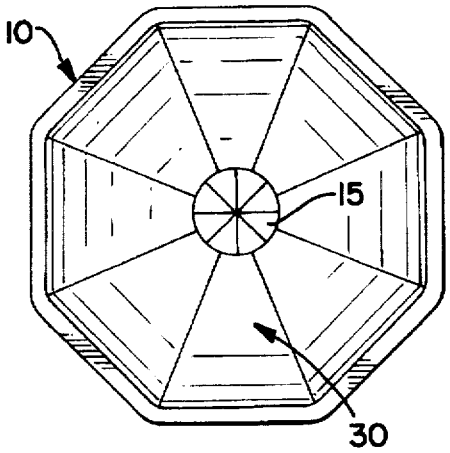
FIG. 8 is an octagonal embodiment of the present invention.
Figure 9:
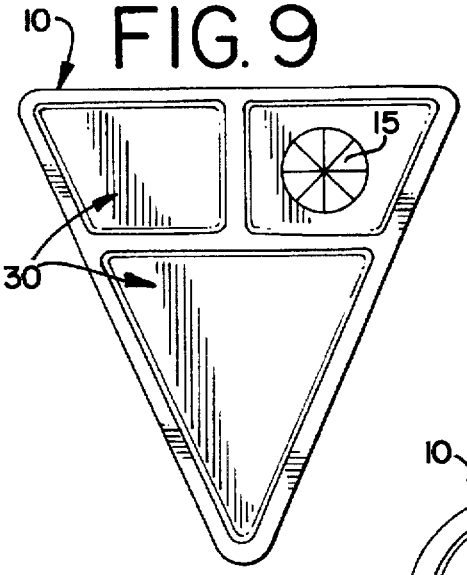
FIG. 9 is a top plan view of a triangular of the present invention.
Figure 11:
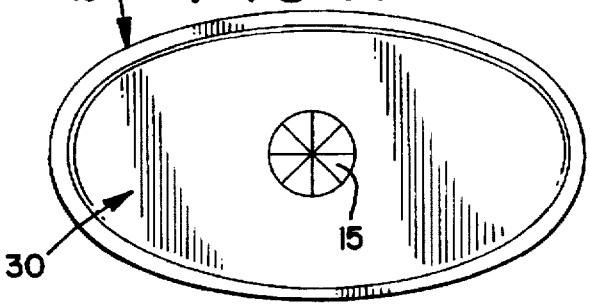
FIGS. 10 and 11 are top plan views of an oval of the present invention.
Figure 10:
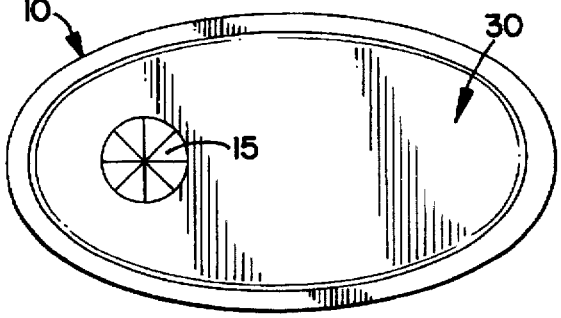

While the invention is susceptible of embodiment in many different forms there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

The plate with beverage fixture 10 is preferably constructed from ordinary materials such as paper, cardboard, styrofoam, plastic or the like, in order to be readily and inexpensively manufactured and to permit the device to be discarded after use. It is noted, however, that it may be made of any suitable ridged material. The present invention provides a neat and inexpensive way of supporting food and any beverage for use at any type of social event while enabling the person to place the food stuffs thereon and thereby freeing the other hand for other purposes such as consumption and/or greeting others at the social event.

As shown in the FIGS. 1–4, the invention 10 has perforations 15 in its flat planar surface which upon the insertion of a cup, bottle, can or other common beverage container 20, releases the perforations 15 creating fingers 25 which are in contact with the beverage container 20. Fingers 25 can actually help stabilize the plate 10 on the container 20 as well as provide the necessary support thereto. The invention is further intended to be used with other types of containers other than beverage, such as sauces in which food can be dipped or condiments like ketchup.

FIGS. 5–10 depict just a few of many desirable shapes that the present invention can be formed. Various segmented portions shown generally as 30, help keep the food stuffs placed thereon isolated and prevent them from running together. The perforations 15 are shown therein which are ready to be adapted to a container which after breaking or separating perforations 15, the invention 10 would be supported by the user by a container.

Figure 12:
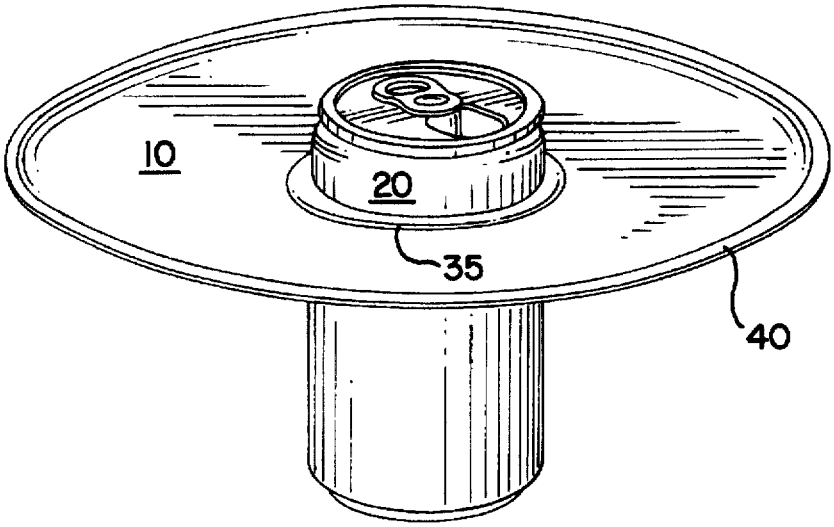
FIG. 12 is a perspective view of alternative embodiment of the present invention in use with a beverage container.
Figure 13:
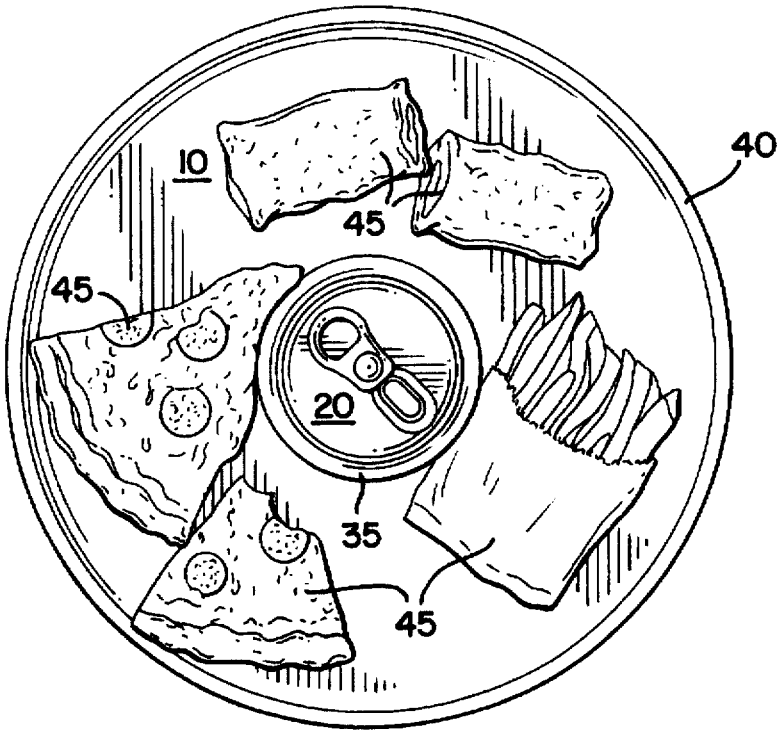
FIG. 13 is a top plan view of the alternative embodiment of FIG. 12 with foodstuffs thereon.

FIGS. 12 and 13 depict an alternative embodiment in which a lip or ridge 35 is formed along the edge of the perforations (not shown) which prevent food from running down the sides of the container 20 inserted therein. Another lip or ridge 40 is formed at the outer edge which also prevents spillage and adds ridgity to the overall plate. FIG. 13 further depicts various food stuffs 45 positioned on the plate 10 with a beverage container 20 such as a can inserted therein.

Figure 14:
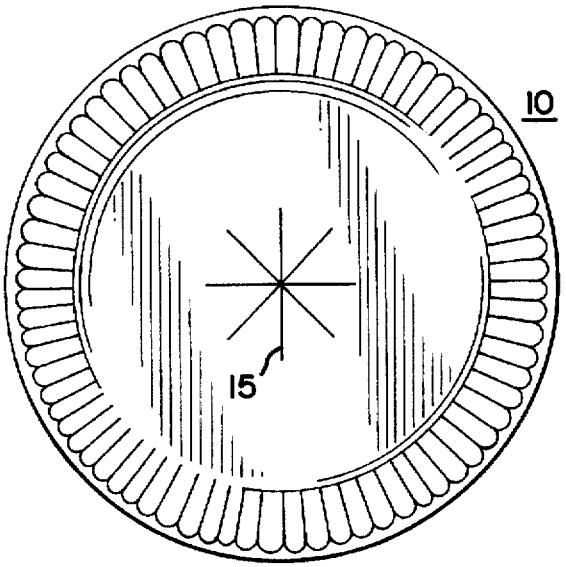
FIG. 14 is a top view of an alternative embodiment of the present invention.
Figure 15:
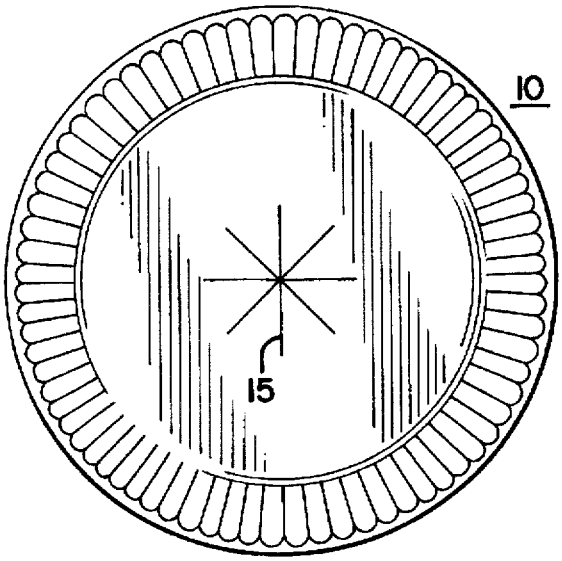
FIG. 15 is a bottom view of an alternative embodiment of the present invention.
Figure 16:
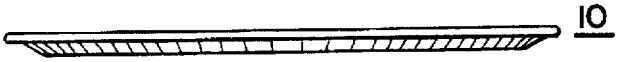
FIG. 16 is a side view of an alternative embodiment of the present invention.

FIGS. 14–16 depict an alternative embodiment of the present invention with perforations 15 formed in the plate 10 by meaning of a cross hatched cutting means or a die stamping method. The method of perforating large quantities of such materials may be performed in any conventional method. The embodiments shown in FIGS. 14–16 allow a conventional plate to be used in a conventional manner even with the perforations 15 and still can be modified with a beverage container as depicted in the other figures shown. It should also be noted that the invention 10 is still useable as a conventional plate without the need for a container inserted therein because perforations 15, if unbroken would not conflict with such use.

The present invention provides an improved plate with beverage fixture which accomplishes each of the benefits and advantages stated above. The invention is readily portable and can be supported by the beverage hand and is disposable, easy, and inexpensive to manufacture. It is understood however, that the following claims are intended to cover all the generic and specific features.

The foregoing specification describes only the preferred embodiment of the invention as shown. Other embodiments besides the many shown, described and claimed may be articulated as well. The terms and expressions therefore serve only to describe the invention by example only and not to limit the invention. It is expected that others will perceive differences which while differing from the foregoing, do not depart from the spirit and scope of the invention herein described and claimed.

What I claim is:

1. A food support device with beverage support fixture comprising:

a plate means for supporting foodstuffs wherein said plate means is substantially planar surface having a raised lip on an exterior circumference of said substantially planar surface; and said plate means formed of a rigid material having a stiffness sufficient enough to support a plurality of foodstuffs; and a cavity defined within said plate means; and a beverage container removable inserted there within said cavity; and wherein said beverage container is selected from the group consisting of a glass, a bottle, a cup and a can; and said cavity is defined by fingers extending in the plane of the plate means from an exterior perimeter of said cavity inward to the center of said plate means; and said planar surface having a raised lip at said exterior perimeter of said cavity for preventing said foodstuffs from running down the sides of the beverage container; and whereby when said beverage container is inserted into said cavity, said fingers deform into a second position to exert pressure on and resiliently grip said beverage container, thereby supporting said plate means on said beverage container, so that the beverage container provides sole support of said plate means via contact with said fingers of said cavity; and wherein said cavity is defined adaptable to receive one of a plurality of containers of varying diameter; such that once said beverage container is inserted therein and removed, a second container having a diameter different than said first diameter may be inserted while still supporting said plate means.

2. The invention of claim 1, wherein said plate means is a planar surface with an oval configuration.

3. The invention of claim 1, wherein said plate means is a planar surface with a hexagonal configuration.

4. The invention of claim 1, wherein said plate means is a planar surface with a octagonal configuration.

5. The invention of claim 1, wherein said plate means is a planar surface with a triangular configuration.

6. The invention of claim 1, wherein said plate means is a planar surface with a rectangular configuration.

7. The invention of claim 1, wherein said plate means is a planar surface with a square configuration.

8. The invention of claim 1, wherein said plate means is a planar surface with a polygonal configuration.

9. The invention of claim 1, 2, 3, 4, 5, 6, 7, or 8, wherein said planar surface has at least one partition forming at least two sections of said planar surface.

10. A food support device with beverage support fixture comprising:

plate means for supporting foodstuffs wherein said plate means is a substantially planar surface having a raised lip on an exterior circumference of said substantially planar surface, said plate means formed of a rigid material having a stiffness sufficient to support a plurality of foodstuffs;

a cavity defined within said plate means, said cavity is defined by fingers extending in the plane of the plate means from an exterior perimeter of said cavity inward to the center of said plate means;

a first beverage container having a first diameter removable inserted therewithin said cavity, said first beverage container is selected from the group consisting of a glass, a bottle, a cup and a can;

whereby when said first beverage container is inserted into said cavity, said fingers deform to exert pressure on and resiliently grip said first beverage container, thereby supporting said plate means on said first beverage container, so that the beverage container provides sole support of said plate means via contact with said fingers of said cavity;

said substantially planar surface having a raised lip at said exterior perimeter of said cavity for preventing said foodstuffs from running down the sides of the beverage container;

said first beverage container is selectively removable from said cavity, said fingers move back towards planar juxtaposition with said plate means without losing their resiliency when said first beverage container is removed from said cavity;

said cavity adaptable to receive a second beverage container having a second diameter when said first beverage container is removed and said fingers move back towards planar juxtaposition with said plate means;

said second beverage container is selected from the group consisting of a glass, a bottle, a cup and a can; and said fingers deform to exert pressure on and resiliently grip said second beverage container upon insertion of said second beverage container into said cavity, thereby supporting said plate means on said second beverage container, so that the beverage container provides sole support of said plate means via contact with said fingers of said cavity.

11. The invention of claim 10, wherein said second diameter of said second beverage container is smaller than said first diameter of said first beverage container, said fingers having a resiliency sufficient to support a smaller second diameter.

12. A food support device for use in combination with one of a plurality of varying diameter beverage containers selected from the group consisting of a glass, a bottle, a cup and a can, said device comprising:

a single horizontal planar circular surface having a diameter and being formed of a rigid material sufficient to support a plurality of foodstuffs;

a cavity in said surface for interchangeably receiving said one of a plurality of varying diameter beverage containers, said cavity having a diameter and being defined by resilient fingers;

said resilient fingers being pie-shaped and extending in the plane of said surface from an exterior perimeter of said cavity inward to a center of said plate means while in a first position;

a raised lip on said planar circular surface at said exterior perimeter of said cavity;

said fingers resiliently deform to a second position and grip said one of a plurality of varying diameter beverage containers when said cavity interchangeably receives said one of a plurality of varying diameter beverage containers, thereby supporting said surface on said one of a plurality of varying diameter beverage containers by preventing said surface from slidable moving along a side surface of said one of a plurality of varying diameter beverage containers; and said fingers resiliently move back towards said first position upon the removal of said one of a plurality of varying diameter beverage containers.

13. The invention of claim 12, wherein said diameter of said cavity is at least one fourth the size of said diameter of said planar circular surface.

14. The invention of claim 12, wherein said planar circular surface includes a raised lip on an exterior circumference of said planar circular surface.

* * * * *